United States Patent [19]

Adamski et al.

[11] 4,196,772

[45] Apr. 8, 1980

[54] TUBULAR HEAT EXCHANGER

[75] Inventors: Joseph R. Adamski, Brighton; Robert F. Bowen, Burlington, both of Mass.

[73] Assignee: Raytheon Company, Lexington, Mass.

[21] Appl. No.: 955,845

[22] Filed: Oct. 30, 1978

[51] Int. Cl.[2] ..... F28F 1/02

[52] U.S. Cl. ..... 165/46; 165/136; 165/169

[58] Field of Search ..... 165/46, 169, 135, 136

[56] References Cited

U.S. PATENT DOCUMENTS

| | | | |
|---|---|---|---|
| 2,625,804 | 1/1953 | Patch et al. | 165/46 |
| 3,148,675 | 9/1964 | Menuto | 165/46 |
| 3,443,060 | 5/1969 | Smith | 165/46 |
| 3,452,555 | 7/1969 | Thurman et al. | 165/46 |
| 3,739,842 | 6/1973 | Whalen | 165/169 |
| 4,061,184 | 12/1977 | Radcliffe | 165/169 |
| 4,109,707 | 8/1978 | Wilson et al. | 165/46 |

FOREIGN PATENT DOCUMENTS

| | | | |
|---|---|---|---|
| B 33502 | 7/1956 | Fed. Rep. of Germany | 165/169 |
| 1163864 | 2/1964 | Fed. Rep. of Germany | 165/169 |
| 2441664 | 3/1976 | Fed. Rep. of Germany | 165/169 |
| 1286751 | 12/1962 | France | 165/46 |

*Primary Examiner*—Sheldon Richter

*Attorney, Agent, or Firm*—M. D. Bartlett; J. D. Pannone; H. W. Arnold

[57] ABSTRACT

A heat exchanger for efficiently transferring heat from a first fluid body to a second fluid body within a selected container, tank or reservoir, comprising an elongated tubular hoselike plastic body of deformable material wrapped around the container and filled with the first heated fluid, the plastic body being deformable under the pressure of the first fluid so as to conform to the exterior surface of the container whereby more efficient transfer of heat between the fluids is achieved.

3 Claims, 4 Drawing Figures

TUBULAR HEAT EXCHANGER

BACKGROUND OF THE INVENTION

The present invention is concerned with the transfer of heat from a first body of fluid to a second body of fluid. The obvious way to achieve this is merely by replacement of the second fluid by the first heated fluid. However, replacement is not always desirable or even possible.

For example, in a solar water heating system a tank or reservoir of cool or cold water is conveniently located as in a building and is connected to one or an array of solar collectors disposed adjacent or on the roof of the building. In the known and conventional solar water heating system a pump is utilized to pump cold water from the tank to and through the collectors. While in the collectors, the water will become heated by solar energy and will then flow back into the tank, displacing some of the cold water.

Such a system poses several problems. For example, in cold weather, especially at night, the collectors are not effective to heat the water and, therefore, the water must be drained to prevent freezing. To overcome this problem antifreeze solutions are often added to the water. However, this pollutes or contaminates the water and greatly limits the uses to which the water may be put.

Certain state and local codes require that at least two barriers be maintained between the nonfreezing agent and potable water. Therefore, it has been contemplated that the water in the solar collector loop may be used to heat a separate body of water, such as drinkable tap water, by disposing the tap water in a tank or reservoir and surrounding or enclosing the tank within the heated water which may be contained as in a double-walled metal wrap-around heat exchanger. By virtue of the physical contact between the wrap-around heat exchanger and the tank, heat from the water in the heat exchanger will pass into the water in the tank.

Such heat exchangers, however, are expensive and somewhat inefficient because the adjacent surfaces of the heat exchanger and tank do not readily conform, thus producing losses in heat transfer performance. This problem has been at least partially overcome by the device disclosed in U.S. patent application Ser. No. 925,025, filed July 17, 1978 by Hapgood and Knight, Jr. and assigned to the same assignee as the present invention . The device in said application comprises a wrap-around heat exchanger in the form of a hollow plastic body shaped similar to a mattress and having convolutions through which the heated fluid passes. However while such heat exchangers are practical and functional, they also are relatively difficult to fabricate and, consequently, comparatively expensive.

SUMMARY OF THE INVENTION

The above and other disadvantages of prior art heat exchangers of the above character are overcome by the present invention wherein a heat exchanger of plastic material is spirally wrapped around a tank of cold water, the heat exchanger being of doublewalled construction similar to a hose and having within it the circulating heated water from the solar collectors.

The inner plastic side or wall of the heat exchanger will be urged into close physical engagement with the outer wall of the tank by the pressure of a rigid casing which encloses the exchanger, close contact between the surfaces of the exchanger and the tank being maintained substantially continually throughout the entire areas of engagement.

The plastic material is thin tubing of suitable material such as polybutylene, polyvinylchloride or teflon about 0.010 thick and is formed as a preferably ovate structure with the internal space being occupied by the water circulating from the solar collectors. The exchanger is provided at one end with an inlet and at its opposite end with an outlet whereby the solarheated water will circulate completely through the exchanger. Thus the exchanger is provided with a continuous tubelike passageway spirally wound around the tank from the inlet to the outlet.

The enclosing casing is preferably a relatively rigid layer of insulating material which functions, with the water, to urge the exchanger into efficient heat transfer contact with the tank, and also to prevent escape of heat from the exchanger. Alternatively the exchanger is encased within a metal shroud which in turn is overlayed with the layer of insulating material. In either case, the assembled structure is then enclosed within an outer metal housing or wrapper to complete the finished product.

BRIEF DESCRIPTION OF THE DRAWINGS

The above and other objectives of this invention will become apparent from the following description taken in connection with the accompanying drawings, wherein.

DESCRIPTION OF THE PREFERRED EMBODIMENTS

Figure 1:
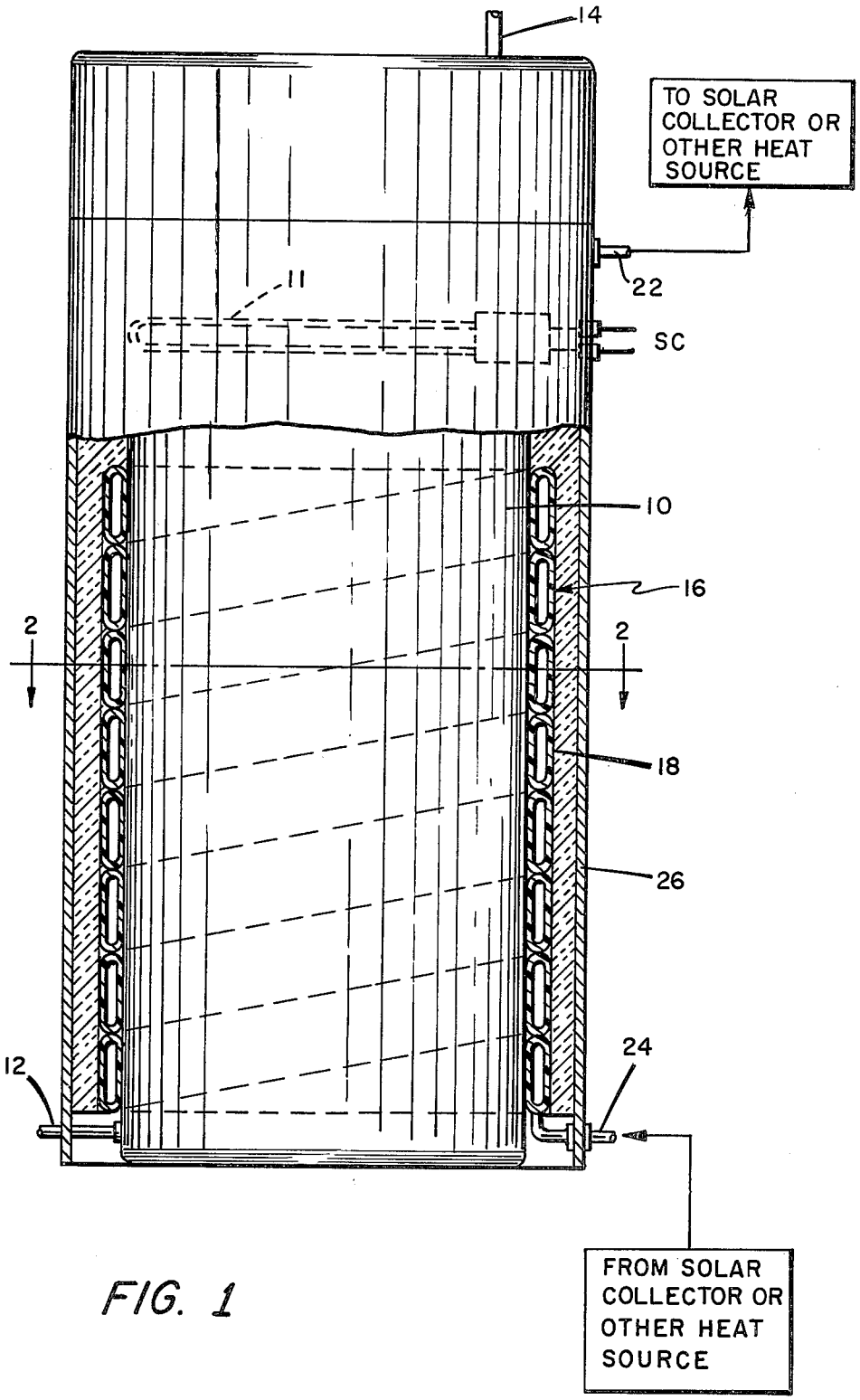
FIG. 1 is an elevational view of a water tank enclosed by the heat exchanger of the invention, with the exchanger and encircling casing being shown in vertical section.

Referring more particularly to the drawings wherein like characters of reference designate like parts throughout the several views, there is shown in FIG. 1 a conventional upright metal tank 10 into which water, such as tap water, may be inserted and withdrawn through suitable inlet and outlet pipes 12 and 14. Such tanks 10 are usually made of steel and provided with glass linings and, as is well known, their outer surfaces contain many irregularities.

In an upper portion of the tank 10 is a conventional thermostatically controlled heating element 11 which may be connected to a source of electrical energy SC as is well known whereby the upper portion of the body of water in the tank may be maintained at a selected temperature.

In accordance with this invention the water in the tank is additionally heated by a low energy source such as one or more solar collectors. It is desirable and necessary, however, that the water in the tank be thus additionally heated by means which will not pollute or contaminate as would occur if the water in the tank were itself circulated through a solar collector array and contained a solution to prevent freezing.

Figure 3:
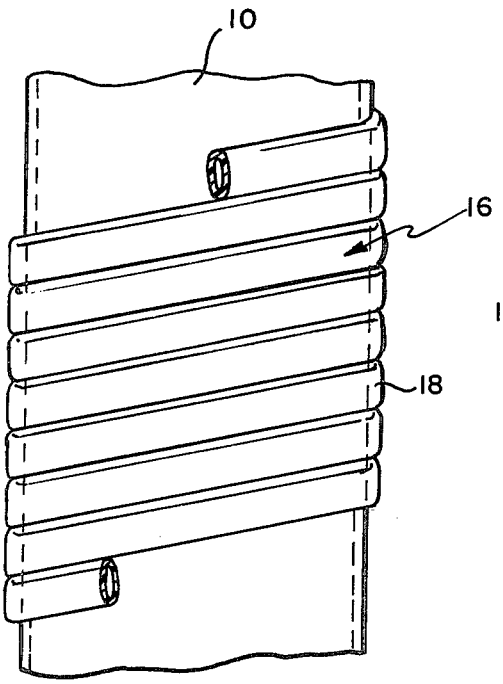
FIG. 3 is an elevational view of a portion of an exchanger illustrating how the exchanger is wrapped around the tank.

In the system shown in FIG. 1, there is provided a wrap-around heat exchanger which is of a material which conforms under pressure to irregularities in the outer surface of the tank. Such a conformable heat exchanger 16 is shown in FIG. 3 and resembles a continuous length of hose or tubing 18 having, preferably, an ovate sectional configuration. The tubing 18 is preferably made of a flexible plastic such as polybutylene, polyvinylchloride, tetrafluroethylene, fluorinated ethylene propylene, or nonporous flexible thermoplastic elastomer.

Figure 2:
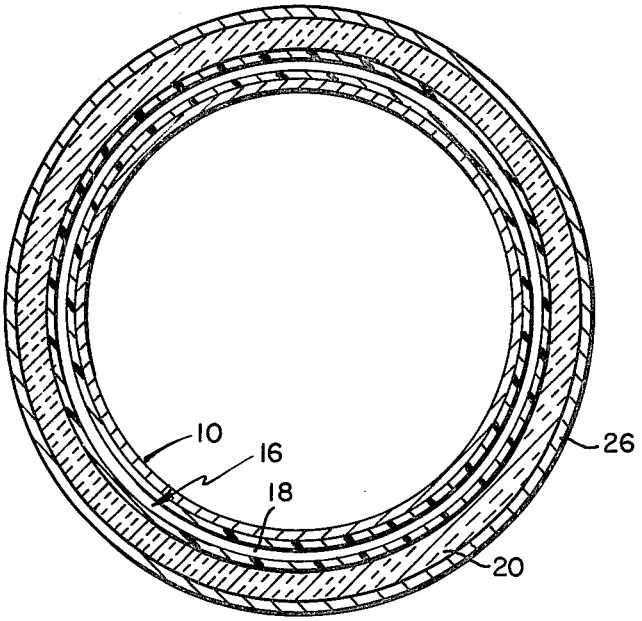
FIG. 2 is a horizontal sectional view taken substantially along line 2—2 of FIG. 1.

The flexible exchanger 16 may be wrapped around the tank 10 in a spiral as shown in FIG. 3, which preferably covers only the area of the tank 10 which lies below the level of the heating element 11 and is retained in place by an inflexible shell or casing 20 of heat insulating material as shown in FIGS. 1 and 2. The interior of the tubing may then be filled with the water which is to be circulated through the solar system. This is achieved by means of an inlet coupling 22 at the upper end of the tubing 18, with the water being withdrawn through an exit coupling 24 at the other end.

It will be seen that with water in the heat exchanger under relatively low pressure such as is used in solar piping circuits, the restraining force of the encircling insulator casing 20 will cause sufficient pressure upon the tubing 18 to cause it to fit into the irregularities of the tank surface. This factor, plus the thinness of the tubing wall, preferably not greater than about 0.010 inch, will produce efficient heat transfer from the fluid in the heat exchanger to the tank.

The exchanger tubing 18 may be made by any well known tubing manufacturing process so that it will have the ovate or flat shape in its extruded form. The inlet and outlet couplings or fittings 22 and 24 may be any standard device which will stay in suitably sealed assembly with the plastic material of the tubing 18, but will preferably be of the type disclosed in U.S. patent application Ser. No. 935,405, filed Aug. 21, 1978 by the same inventors as the presently described invention and assigned to the same assignee as the present invention.

The insulating shell or casing 20 is preferably a layer of high value rigid insulation, or a closed cell expanded foam which may be foamed in place or preformed as a wraparound shell. Such insulating material as polyethylene or a rigid closed cell urethane foam may be used.

An outer wrap 26 of sheet metal encases the insulating layer 20 and aids in its support upon the tubing 18, preventing the insulation from being displaced when water is applied to the heat exchanger 16. Wrap 26 comprises the finished outer enclosure for the apparatus.

It will be apparent that when the heat exchanger 16 is pressurized, the inner wall of the tubing 18 will be forced against the surface of the water tank 10, providing efficient thermal conductivity therebetween such as will cause heat from the water in the heat exchanger to be efficiently transferred through the walls of the tubing and tank directly to the water in the tank.

Figure 4:
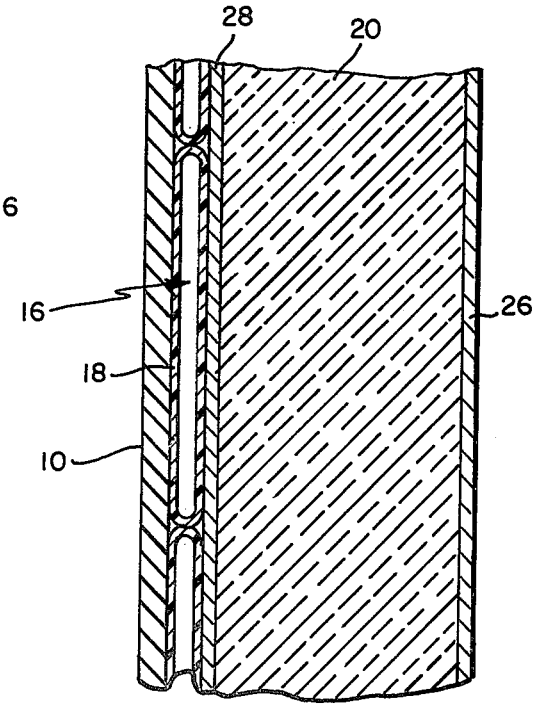
FIG. 4 is an enlarged fragmentary sectional view of a modified form of enclosure for the heat exchanger.

The embodiment of the invention shown in FIG. 4 employs a heat exchanger 16 formed as tubing 18 spirally wrapped around the tank 10, and a layer 20 of insulation held in place by a metal casing 26. However, a thin metal support shroud 28 is disposed between the heat exchanger 16 and the insulating layer 20 for use when the insulating layer 20 is not self-supporting, such as ordinary fiber glass batting.

From the foregoing it will be apparent that a hollow flexible or conformable tubular heat exchanger 16 as described may be spirally wrapped upon the outside surface of a tank and retained in place by an encircling casing. The inlet and outlet connectors 22 and 24 may then be connected into the piping circuit of a solar heating system whereupon heated water from the solar collectors will pass through the heat exchanger. The pressure of the water, together with the restraining characteristics of the rigid insulating casing will forcibly urge the inner wall of the exchanger into conforming engagement with the irregular surface of the tank. Thus, efficient transfer of heat from the water in the heat exchanger to the tank is achieved, resulting in heating of water in the tank.

In this way, heated water from the solar collectors or other source may be utilized to supplement the heat provided by the heating element 11, thus resulting in reduced operation of the heating element 11 with consequent decrease in energy consumption.

From the foregoing it will be apparent that various changes and modifications of the invention may be made by those skilled in the art without departing from the spirit of the invention as expressed in the accompanying claims. Therefore, all matter shown and described is to be interpreted as illustrative and not in a limiting sense.

What is claimed is:

1. A heat exchange system comprising a container containing fluid to be heated and having an irregular surface, a heat exchanger of tubular flexible material disposed in a tight spiral winding around said container with one surface in close juxtaposition with the irregular surface of the container, said surface being conformable to the irregularities in the irregular surface, a first rigid pressure-applying casing overlying the opposed surface of the heat exchanger, a layer of insulation overlying the first rigid casing, a second rigid casing covering and supporting the layer of insulation, and means for circulating fluid through the heat exchanger at a pressure sufficient to cause said conformable surface to conform with said irregularities in said irregular surface of the tank whereby heat in said container.

2. A heat exchange system as set forth in claim 1 wherein said layer of insulation is soft nonself-supporting material.

3. A heat exchange system as set forth in claim 1 wherein an electric heating element is mounted in the upper portion of the container, and the heat exchanger covers the area of the container which is below the level of the heating element.

* * * * *